US005383312A

United States Patent [19]

St. Louis et al.

[11] Patent Number: 5,383,312

[45] Date of Patent: Jan. 24, 1995

[54] CONTAMINANT SHIELD

[75] Inventors: Daniel M. St. Louis, West Bloomfield; Ricky D. Schmidt, Macomb, both of Mich.

[73] Assignee: Haden Schweitzer Corporation, Madison Heights, Mich.

[21] Appl. No.: 148,894

[22] Filed: Nov. 8, 1993

[51] Int. Cl.[6] ..... E04B 1/12

[52] U.S. Cl. ..... 52/63; 52/202; 52/222

[58] Field of Search ..... 52/273, 222, 63, 202; 135/101, 97; 156/325, 306.6; 160/327, 354, 368.1, 369, 383

[56] References Cited

U.S. PATENT DOCUMENTS 3,679,505 7/1977 Hinderaker et al. ..... 52/202 X
4,068,428 1/1978 Peterson, III ..... 52/202
4,273,827 6/1981 Sweeney et al. ..... 156/306.6 X
4,769,962 9/1988 Pohl et al. .
4,860,778 8/1989 Pohl .
4,909,004 3/1990 Pantilla ..... 52/202 X
5,203,129 4/1993 Johnson ..... 52/202

*Primary Examiner*—Carl D. Friedman
*Assistant Examiner*—Creighton Smith
*Attorney, Agent, or Firm*—Niro, Scavone, Haller & Niro

[57] ABSTRACT

An improved contaminant shield and method for making the shield, including a frame constructed of interconnected frame members. A double-sided adhesive tape meeting certain temperature-induced and load-induced creep performance characteristics is attached to outside portions of the frame, and flexible sheeting affixed to the adhesive. Single-sided adhesive tape, or other connectors, are applied to seal the joints between the sheets.

9 Claims, 1 Drawing Sheet

CONTAMINANT SHIELD

BACKGROUND OF THE INVENTION

The present invention relates in general to shields used to prevent air-borne particles from contaminating the environment within the shield. More particularly, the invention relates to clean environment enclosures typically employed in paint operations in manufacturing plants.

In manufacturing facilities where products are painted, it is necessary that the environment immediately surrounding the paint operation be as free as possible from dust, dirt and other air-borne contaminants in order to provide the best application of paint to the product.

Various forms of enclosures have been used to prevent air-borne contaminants from interfering with the paint application process. Such contaminant shields or "clean environment enclosures" are typically provided with positive airflow into the enclosure to prevent dust and dirt from entering the open ends of the enclosure. They are built of rigid side and top panels with opposed ends, with an attached flexible sheet(s) covering the periphery.

Two examples of prior art contaminant shields are disclosed in U.S. Pat. Nos. 4,769,962 and 4,860,778. These enclosures are relatively expensive to manufacture and require relatively lengthy installation time. For example, with each of these prior art shields flexible sheets are attached to individual panels in a relatively complicated manner, using a "tongue-in-groove" system, with clamps also being employed for further support.

It would therefore be desirable to provide a controlled environment enclosure which can be more easily and inexpensively constructed, quickly altered in structure for different applications and easily repaired.

SUMMARY OF THE INVENTION

The present invention is a controlled environment or contaminant shield enclosure which provides a clean environment ideally suited for paint operations in manufacturing plants. The enclosure includes a modular frame having a plurality of interconnected structural members. An adhesive medium, novel for this application, and having inner and outer opposing adhesive surfaces, is also employed. The inner adhesive surface of the adhesive medium is applied to the outer surface of the frame. The edges of a thin flexible sheeting are then affixed to the outer surface of the adhesive medium. In a preferred embodiment, the adhesive medium is double-sided tape. In alternative embodiments, the flexible sheeting can be a single, continuous sheet, or can include a plurality of sheets. In the latter case, for example, the interconnected frame members can form a plurality of individual panels, and each sheet can be appropriately sized to span an individual panel.

In alternative embodiments, a single flexible sheet can be used to cover the entire frame, or individual sheets can be used to cover portions of the frame. For example, individual sheets can be sized to cover the separate modules or panels forming the frame.

The present invention also includes the method of constructing this contaminant shield. A plurality of elongated, structural members are joined to form a frame, by any one of various means known to those of skill in the art. Next, an adhesive medium with inner and outer adhesive surfaces, such as double-sided tape, is applied to the outer surface of the frame. Flexible sheeting is then attached to the outer surface of the adhesive, under tension, so as to form a relatively smooth and substantially taut surface, covering the frame. Alternatively, the sheeting is heat shrunk to provide a relatively smooth and substantially taut surface.

The contaminant shield of the present invention provides unique advantages regarding the construction or repair of such shields or barriers, since it minimizes installation and service time, and reduces the manufacturing cost. For example, the individual panels, and then the frame, can be constructed on site. The advantage of mass producing identical or nearly identical frames is obtained, as well.

An object, therefore, of the present invention is to provide an contaminant shield which can be constructed from inexpensive materials.

Another object of the present invention is to provide a contaminant shield which can be quickly constructed in the field.

A further object of the present invention is to provide a contaminant shield which can be assembled into a variety of shapes, and which can be easily altered or repaired.

BRIEF DESCRIPTION OF THE DRAWINGS

The various features, advantages and other uses of the present invention will become more apparent by reference to the following drawings and detailed description in which.

DETAILED DESCRIPTION OF THE PREFERRED EMBODIMENTS

Figure 1:
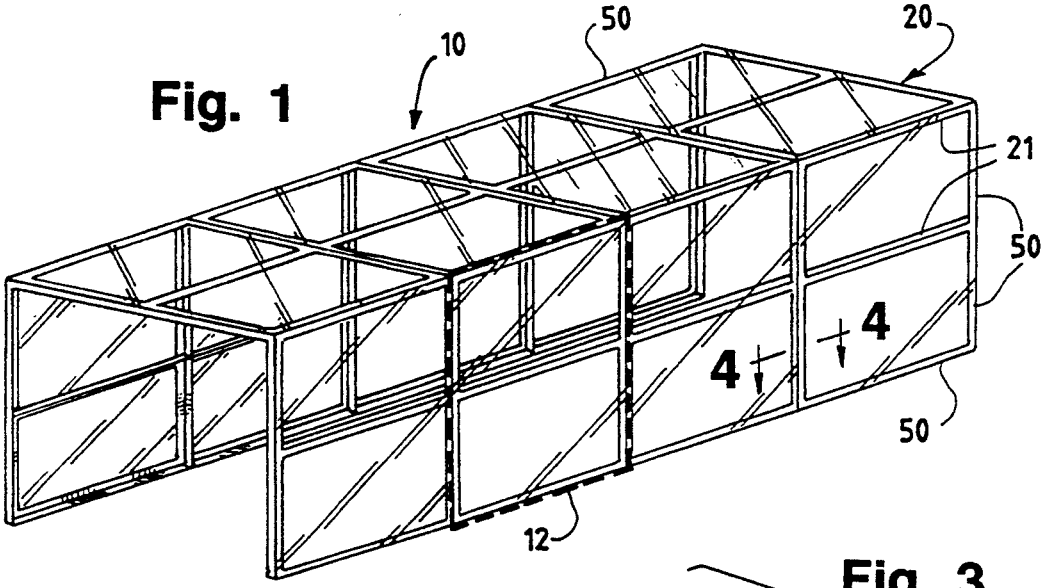
FIG. 1 is a perspective view of the assembled contaminant shield forming one embodiment of the present invention.

The contaminant shield of the present invention typically forms an enclosure, shown generally as 10 in FIG. 1, and includes a frame, shown generally as 20 in FIG. 1, which consists of two sides and a top, and provides a contaminant-free environment ideally suited for use in paint operations in a manufacturing plant. Frame 20 is constructed of structural frame members 21, which may extend horizontally and vertically, and can form individual panels or modules 12, as shown in FIG. 1. Of course, frame members 21 may be formed so as to extend at any angle. Also, panels 12 may consist of either one or a number of frame members 21, and may be formed in any shape, as further described below. In the embodiment of FIG. 1, frame members 21 are spaced to form vertically extending sides, a roof and opposed open ends, to allow positive airflow through the enclosure.

Figure 4:
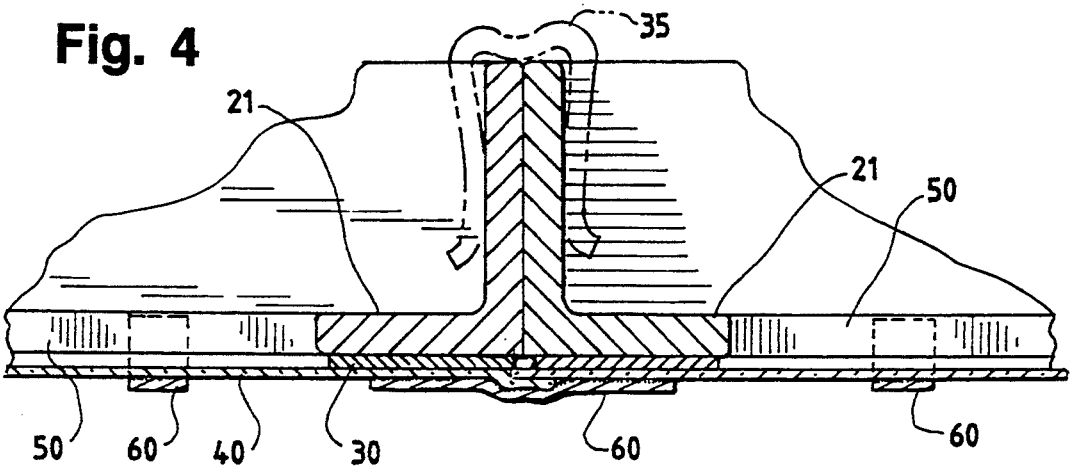
FIG. 4 is an enlarged cross-section view of the joint section of two adjacent panels, taken along section line 4—4 of FIG. 1.

Frame members 21 may be coupled by any expedient method. For example, frame members 21 can be provided which are hollow, and which are sized to slide within one another. Alternatively, frame members 21 can be fastened to each other by any suitable fastening means, such as screws or other fasteners. Alternatively, a single frame member can be formed into a single panel. Adjacent frame members 21 or adjacent panels 12 may be secured by a clip 35 (as shown in FIG. 4), or any other known attaching mechanism, such as glue or fasteners; however, these means of attachment are not necessary for use of the present invention.

Figure 2:
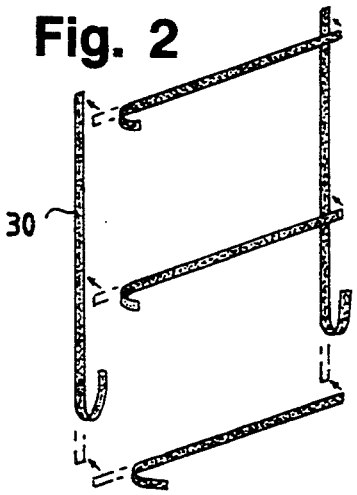
FIG. 2 is a perspective view of the double-sided tape used in a preferred embodiment of the present invention.
Figure 3:
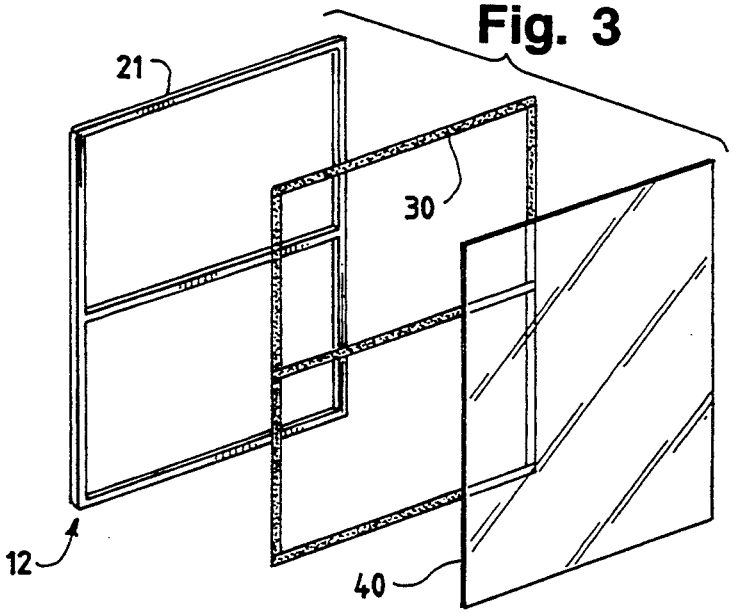
FIG. 3 is an exploded perspective view of a portion of the frame, and the double-sided tape and flexible sheeting associated with that frame, utilized in the preferred embodiment.

To construct one embodiment of the contaminant shield of the present invention, individual panels or modules 12, consisting of frame members 21, are first formed. Next, a double-sided adhesive, such as double-sided adhesive tape 30, shown in FIG. 2, is applied to the outside of frame members 21 (preferably, the tape width equals the frame member width). Then a single continuous flexible sheet 40 (such as 6 mil. polyethylene) is sized to fit the entire frame or, alternatively, groups of flexible sheets 40 are sized to fit groups of panels. After the flexible sheet or group of sheets 40 are attached to one surface of double-sided tape 30, heat can be applied to the shield to shrink the flexible sheet/s. The sheet/s will now form a relatively taut, smooth surface covering the top and sides of the frame, and spanning each panel.

In an alternative preferred embodiment, after the frame is constructed, double-sided adhesive tape 30 is attached to the frame members 21 of each module 12 and individual, appropriately sized flexible sheets are attached to cover each module. Adjacent modules are again joined by any suitable means, such as single-sided adhesive tape. The sheets can be sized to allow overlap between adjacent modules. Any suitable fastening means, such as single-sided adhesive tape, can then be applied to this overlap region to seal the joints between the modules, and to enhance the shear strength of the sheets spanning the frame. Again, once the modules are interconnected and the frame is formed, the application of heat will allow sheets of an appropriate material such as polyethylene (e.g., visquine) to shrink, giving the sheeting a residual tensile stress and providing a relatively smooth surface covering the frame.

It should be emphasized that the present invention allows for several alternatives constructions. The whole frame can first be built out of panels, and then either a large single flexible sheet, or smaller individual sheets, can be used to cover the frame in the manner described above. Alternatively, after the construction of each module, appropriately sized individual sheets can be affixed to each module in the manner described above, and then the individuals modules can be interconnected (by, for example, single-sided adhesive tape) to form the frame. In either case, whenever overlapping or adjacent flexible sheets are present, these regions of overlap can be sealed (with, for example, single-sided adhesive tape) in the manner described above.

In either embodiment (i.e., whether a single sheet or a number of sheets are used), it is preferred that an adhesive, such as single-sided tape 60, is wrapped around portions of various edges 50 of the frame, as shown in FIG. 4. This will further enhance the resistance of enclosure 10 to shear stresses as the sheeting is heated.

While sheeting materials other than polyethylene can be used, such as polyester (e.g., mylar), vinyls, or various cloths or fabrics, these materials do not shrink substantially with heat, and therefore would require pre-tensioning of the sheets during placement. Of course, the sheets can be pre-tensioned during attachment to frame 20, alleviating the need for the application of heat to the sheeting.

Enclosure 10 of the present invention can be constructed quickly and inexpensively. While the frame can be constructed of any relatively strong, relatively light weight material, such as steel, fiberglass, or aluminum, galvanized tube steel is preferred, due to its strength and rigidity, its resistance to rust, its inexpensiveness, and the fact that it can be readily obtained in large quantities. Frame members constructed of tube steel can be easily handled (since slender and light weight) and provide sufficient strength so as not to significantly bow under tension as the sheeting shrinks during heating.

Individual frame members can be connected to form any geometrical shape, so that square, rectangular or triangular panels or modules can be utilized. As mentioned above, frame members can be connected to each other by any means known to those of skill in the art, including various metal fasteners, such as bolts or thumb screws, or by the use of socket joints (i.e., a tube-within-a-tube fit).

The double-sided adhesive which was selected for use in affixing the sheeting 40 to the frame 20 is a novel application in the context of the present invention. Initially, it was determined that tape was an expedient method of connecting sheeting to a frame, due to its ease in application, and instant, pressure-sensitive connection. Testing was then required to determine the proper adhesive tape to be used. The parameters for adhesive selection were generally determined to include: 1) creep resistance to the heat typically found in manufacturing plants where paint operations occur; 2) shear strength of tape-sheeting bond; 3) ultimate tensile strength of tape as compared to ultimate tensile strength of sheeting; 4) ease of use and repairability; and 5) economic considerations.

More specifically, the selected tape would be required to withstand substantial creep in the presence of temperatures varying between 100° F. and 160° F. As ambient temperatures increase, and sheeting shrinkage progresses, the tensile stresses within the plastic sheeting will increase. Therefore, the ultimate tensile strength (i.e., "tear strength") for a given width of tape should exceed the ultimate tensile strength of the plastic sheeting. Of course, the tape tear strength should also exceed the tear strength of the tape-sheeting bond. This will guarantee that the sheeting will fail before the tape, allowing the construction of the strongest possible contaminant shield for a given sheeting over a range of temperatures. (It will be understood that both the tear strength for the selected sheeting material, as well as the ultimate shrinkage for the sheeting, can be easily determined, either experimentally, or from available materials handbooks.)

A number of different types of adhesives were evaluated based upon these parameters, and four were ultimately selected for testing on a 6 mil. polyethylene sheet spanning a 3-foot by 3-foot galvanized steel frame (2-inch by 2-inch tube steel).

The first test, "Test No. 1," consisted of a "shear-strength" creep test: a 16-pound pail of water was placed on the center of the plastic film for a period of 72 hours. As shown below, three of the four selected double-sided tapes passed this test without exhibiting significant creep. The second test, a "shear temperature" creep test, "Test No. 2," consisted of the same test as the first test, except that the three remaining frames were subjected to 120° F. for 10 minutes. As shown below, two tapes passed this test. The particularly preferred double-sided tape is a 2-inch wide by 5 mils. thick brand of tape manufactured by 3M and identified as "F9755PC"; this tape was selected over the other 3M brand of tape which passed both creep tests for economic reasons (delivery and cost considerations). The particularly preferred double-sided adhesive tape is described in 3M literature as a "medium firm acrylic pressure-sensitive adhesive system."

A summary of the test results appears below:

TRIAL 1

Tape Used: 2" wide×5 mils thick 3M brand F9755 PC tape

RESULTS FROM TRIAL 1

A. Test #1: Passed test with no visible creeping
B. Test #2: Passed test with no visible creeping

TRIAL 2

Tape Used: 2" wide×5 mils thick Tesafix 4965 tape

RESULTS FROM TRIAL 2

A. Test #1: Passed test with no visible creeping
B. Test #2: Unacceptable amount of creeping occurred

TRIAL 3

Tape Used: 2" wide×5 mils thick 3M brand 950 tape

RESULTS FROM TRIAL 3

A. Test #1: Failed test; considerable creeping occurred

TRIAL 4

Tape Used: 1" wide×5 mils thick 3M brand F9469 PC tape

RESULTS FROM TRIAL 4

A. Test #1: Passed test with no visible creeping
B. Test #2: Passed test with no visible creeping Creep movement occurred both as to the plastic sheeting (which moved relative to the metal frame as the tape-plastic bond yielded), and as to the tape (which moved relative to itself). As to the tapes which failed the creep tests, it was observed that under the shear-strength (Trial 3) or shear-temperature (Trial 2) tests the top surface of the tape moved in a direction longitudinal to the tape length, relative to the bottom tape surface. This was apparently due to the flowing of the tape adhesive relative to the tape substrate, and caused the edges of the tapes failing the test (which initially had squared-off edges), to taper in a slanted direction.

A preferred adhesive to serve as the joint connector for sealing adjacent panels is "No. 396 Scotch super bond," a single-sided adhesive "packaging tape" also made by 3M. This tape is shown as 60 at FIG. 4. To further enhance the resistance of the sheeting to shear stresses, this single-sided tape can be applied over the joints of adjacent frame members (and thus over the sheeting or sheeting edges which may overlie such joints).

It will be understood that alternatives to the single-sided adhesive tape 60 employed for sealing the joints between adjacent panels, or for further securing the sheeting to frame members 21 by wrapping around edges 50, can be utilized. As examples, adhesives such as contact cement, double-sided carpet tape, or hot glues may be employed.

Repairs to the contaminant shield of the present invention are easily accomplished in the field. If the sheeting of a particular panel requires replacement, the sheet is simply trimmed away close to the frame member, a new layer of adhesive tape is applied over the existing joint, and a new sheet is applied and heat shrunk.

The present invention enables the construction and use of a contaminant shield which is less costly to manufacture and easier to repair than prior art contaminant shields. It is not necessary, for example, to provide clips, clamps or locking strips for securing the frame members or for sealing the sheeting to the frame. Further, all of the materials required to manufacture the present invention are relatively inexpensive, and readily available in large quantities.

Of course, it should be understood that various changes and modifications to the preferred embodiments described herein will be apparent to those skilled in the art. Such modifications and changes can be made to the illustrated embodiments without departing from the spirit and scope of the present invention, and without diminishing the attendant advantages. It is, therefore, intended that such changes and modifications be covered by the following claims.

What is claimed is:

1. A contaminant shield having a top, two sides, and two opposing open ends, comprising:

a modular frame serving as the structural support for the shield and including a plurality of interconnected, substantially rigid frame members having inner and outer surfaces;

thin flexible sheeting for covering the top and sides of the shield;

an adhesive medium having inner and outer opposing adhesive surfaces, the inner surface of the adhesive medium being applied to at least a portion of the outer surface of the frame members; the adhesive medium being substantially resistant to visible creep at ambient temperatures between about 100° -160° F., and having an ultimate tensile strength greater than the ultimate tensile strength of the sheeting; and the sheeting being affixed to the outer surface of the adhesive medium.

2. The contaminant shield of claim 1, wherein the adhesive medium is double-sided tape.

3. The contaminant shield of claim 2, wherein adjacent frame members are interconnected using single-sided adhesive tape.

4. The contaminant shield of claim 1, wherein the flexible sheeting is a single, continuous sheet.

5. The contaminant shield of claim 2, wherein the frame members form a plurality of individual modules, and the flexible sheeting includes a plurality of sheets each correspondingly sized to span a module.

6. The contaminant shield of claim 2, wherein the double-sided tape is an acrylic, pressure-sensitive adhesive tape.

7. The contaminant shield of claim 5, wherein the edges of adjacent sheets spanning adjacent modules of the frame overlie each other in a plurality of overlap regions, and single-sided adhesive tape is applied to portions of some of these overlap regions.

8. A contaminant shield having a top, two sides and two opposing open ends, comprising:

a modular frame including a plurality of interconnected panels having outer surfaces, with adjacent panels sharing a joint portion;

a first adhesive medium having inner and outer opposing adhesive surfaces, the inner surface of the first adhesive medium being applied to the outer surface of portions of each panel; the adhesive medium being substantially resistant to visible creep at ambient temperatures between about 100°-160° F.;

thin flexible sheeting, the sheeting being affixed to the outer surface of the first adhesive medium, and having an ultimate tensile strength less than the ultimate tensile strength of the first adhesive medium;

a second adhesive medium having an inner adhesive surface for sealing the joint portions between adjacent panels.

9. The contaminant shield of claim 8, wherein the edges of adjacent sheets spanning adjacent panels of the frame overlie each other in a plurality of overlap regions, and the second adhesive medium is applied to portions of some of these overlap regions.

* * * * *